US010395862B2

(12) United States Patent
Kohn

(10) Patent No.: US 10,395,862 B2
(45) Date of Patent: Aug. 27, 2019

(54) ELECTRONIC APPARATUS COMPRISING AT LEAST ONE LUMINOUS BUTTON AND METHOD FOR ASSEMBLING SUCH AN APPARATUS

(71) Applicant: SAGEMCOM BROADBAND SAS, Rueil Malmaison (FR)

(72) Inventor: Stéphane Kohn, Rueil Malmaison (FR)

(73) Assignee: SAGEMCOM BROADBAND SAS, Rueil Malmaison (FR)

( * ) Notice: Subject to any disclaimer, the term of this patent is extended or adjusted under 35 U.S.C. 154(b) by 0 days.

(21) Appl. No.: 16/061,146

(22) PCT Filed: Dec. 9, 2016

(86) PCT No.: PCT/EP2016/080437
§ 371 (c)(1),
(2) Date: Jun. 11, 2018

(87) PCT Pub. No.: WO2017/097977
PCT Pub. Date: Jun. 15, 2017

(65) Prior Publication Data

US 2018/0358192 A1 Dec. 13, 2018

(30) Foreign Application Priority Data

Dec. 9, 2015 (FR) ..... 15 62077

(51) Int. Cl.
*H01H 13/83* (2006.01)
*H01H 13/86* (2006.01)
*H01H 13/88* (2006.01)

(52) U.S. Cl.
CPC ..... *H01H 13/83* (2013.01); *H01H 13/86* (2013.01); *H01H 13/88* (2013.01); (Continued)

(58) Field of Classification Search
CPC .. H01H 13/83; H01H 13/88; H01H 2219/062; H01H 2219/064; H01H 2221/024; H01H 2221/07
See application file for complete search history.

(56) References Cited

U.S. PATENT DOCUMENTS 7,071,434 B1 * 7/2006 McConnell ..... H01H 13/83 200/310
7,629,547 B2 * 12/2009 Heath ..... H01H 13/83 200/310

(Continued)

FOREIGN PATENT DOCUMENTS

DE 2741618 A1 11/1978
DE 202008014509 U1 2/2009
JP 2000106049 A 4/2000

*Primary Examiner* — Felix O Figueroa
(74) *Attorney, Agent, or Firm* — Muncy, Geissler, Olds & Lowe, P.C.

(57) ABSTRACT

An electronic apparatus and a method of assembling the electronic apparatus having a chassis inserted into a housing having a face parallel to the direction of insertion of the chassis in the housing provided with push buttons with light guides projecting into the housing. An electronic board is mounted in the chassis so as to extend parallel to said face of the housing and is provided with switches in order to interact with the push buttons and light sources surrounded by a light-tight frame receiving the free end of the light guides. The light-tight frame has a height which decreases in a direction of separation from the chassis, and the light guides have a height which decreases in the opposite direction so as only to be in contact with one another once the chassis has been completely inserted into the housing.

6 Claims, 3 Drawing Sheets

(52) U.S. Cl.
CPC . *H01H 2219/062* (2013.01); *H01H 2219/064* (2013.01); *H01H 2221/024* (2013.01); *H01H 2223/01* (2013.01); *H01H 2229/062* (2013.01)

(56) References Cited

U.S. PATENT DOCUMENTS

| | | | | |
|---|---|---|---|---|
| 7,661,859 | B2 * | 2/2010 | Nakagawa | H01H 13/83 362/23.01 |
| 2011/0267745 | A1 | 11/2011 | Cheng et al. | |
| 2017/0060062 | A1 * | 3/2017 | Araishi | G03G 15/5016 |

* cited by examiner

ELECTRONIC APPARATUS COMPRISING AT LEAST ONE LUMINOUS BUTTON AND METHOD FOR ASSEMBLING SUCH AN APPARATUS

The present invention relates to manufacturing electronic equipment.

STATE OF THE ART

Electronic equipment is known that includes a chassis engaged inside a box having a front face that is parallel to the engagement direction for engaging the chassis in the box and that is provided with push buttons that are mounted to slide perpendicularly to said front face. Each push button has one end received in a hole made in the front face in order to be flush therewith, and it includes a rectangular light guide projecting into the box behind the front face in order to enable the push button to be illuminated. An electronic card is mounted on the chassis in order to extend parallel to the front face and it is provided with switches designed to co-operate both with the push buttons and also with light sources, each of which is surrounded by a light-tight frame into which the free end of the light guide is designed to engage in such a manner that each push button is illuminated independently from the others.

In order to avoid the push buttons being sheared during assembly, the box and the front face are designed as two separate parts. Thus, firstly, the electronic card and the push buttons are mounted on the chassis, secondly, the box is then engaged on the chassis, and thirdly, the front face, provided with holes for receiving the push buttons, is fastened to the box.

OBJECT OF THE INVENTION

An object of the invention is to simplify the design and assembly of such electronic equipment.

SUMMARY OF THE INVENTION

To this end, the invention provides electronic equipment comprising a chassis engaged in a box having a face parallel to the engagement direction for engaging the chassis in the box and provided with at least one push button that is mounted to slide perpendicularly to said face and that includes a rectangular light guide projecting into said box. At least one electronic card is mounted on the chassis so as to extend parallel to said face of the box and is provided with a switch for co-operating both with the push button and also with a light source that is surrounded by a light-tight frame, which frame receives the free end of the light guide. The frame is of height that decreases on going away from the chassis and the end of the light guide is of height that decreases in the opposite direction so that they come mutually into contact only once the chassis is fully engaged in the box.

Thus, the push button is mounted on the box before the chassis is engaged in the box, and during engagement the free end of the light guide becomes applied against the frame only at the end of engagement. There is therefore no risk of the light guide or of the light-tight frame being sheared.

In a particular embodiment, said face of the box is provided with a plurality of buttons aligned parallel to the engagement direction and the electronic card is fitted with the same number of switches aligned in the same direction, the push buttons and the switches being provided with mutual bearing surfaces of heights that vary with corresponding slopes so that they come mutually into contact only once the chassis is fully engaged in the box.

In such an arrangement with a plurality of push buttons aligned in the engagement direction, varying the heights of the mutual bearing surfaces along corresponding slopes so as to put them mutually into contact only once the chassis is fully engaged in the box makes it possible to eliminate the risk of the switches being sheared, while having a structure that is simple.

The invention also provides a method of assembling such equipment, comprising the steps of:

- mounting on the electronic card the switch for co-operating with the push button and the light source surrounded by the light-tight frame;
- mounting the electronic card on the chassis so that it extends parallel to the engagement direction;
- mounting the push button and the light guide on the face of the box that is parallel to the engagement direction in such a manner that the push button slides perpendicularly to said face and the light guide projects into the box; and
- engaging the chassis in the box along the engagement direction until the light-tight frame and the end of the light guide come mutually into contact.

Other characteristics and advantages of the invention appear on reading the following description of particular, non-limiting embodiments of the invention.

BRIEF DESCRIPTION OF THE FIGURES

Reference is made to the accompanying drawings, in which.

DETAILED DESCRIPTION OF THE INVENTION

Figure 1:
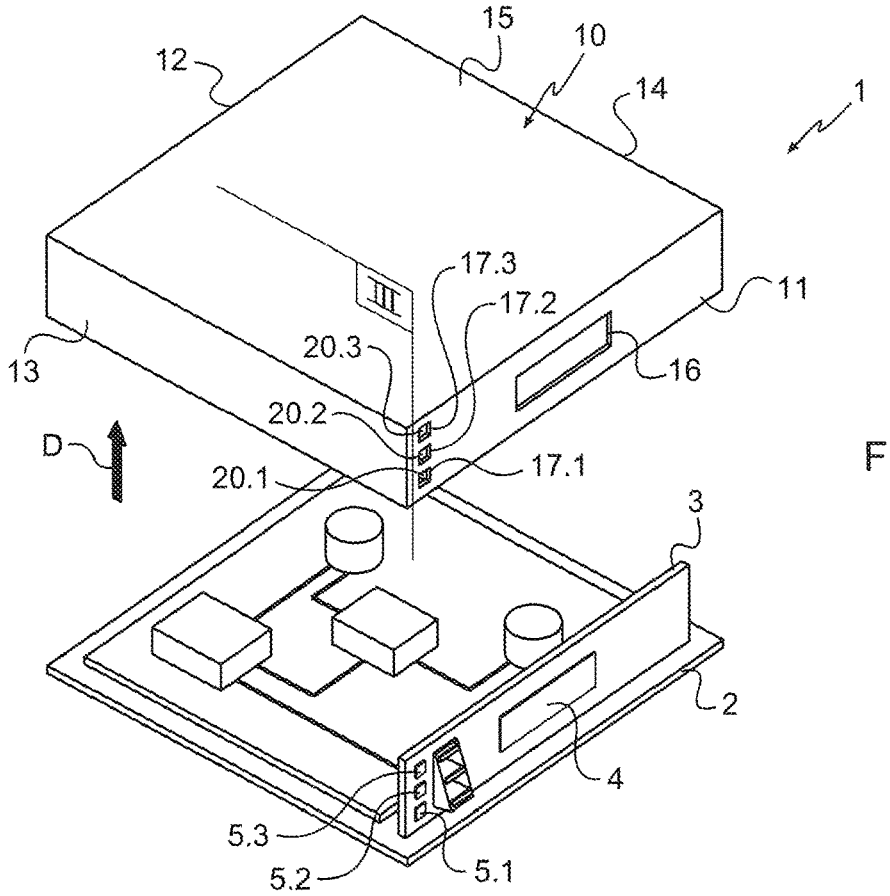
FIG. 1 is an exploded diagrammatic perspective view of a piece of electronic equipment of the invention.
Figure 2:
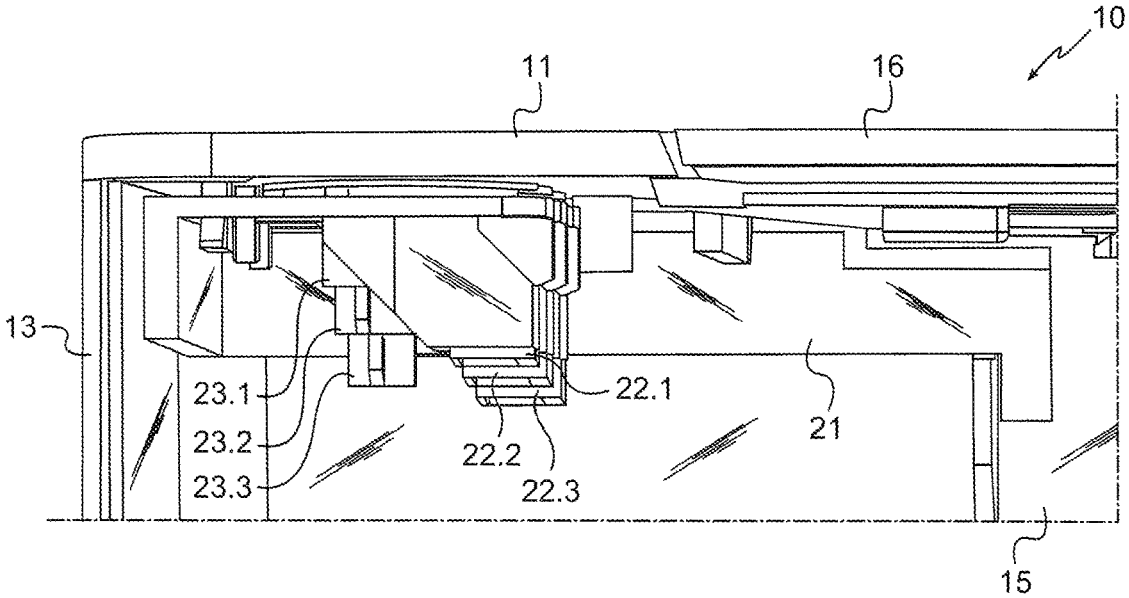
FIG. 2 is a fragmentary view of the underside of the box of the equipment.
Figure 3A:
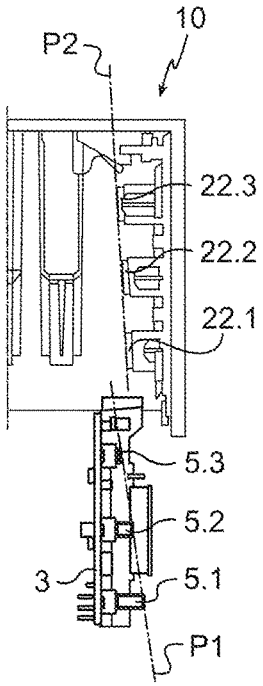
FIGS. 3A to 3D are fragmentary views in section on plane III of FIG. 1 showing how the chassis is engaged in the box.
Figure 3B:
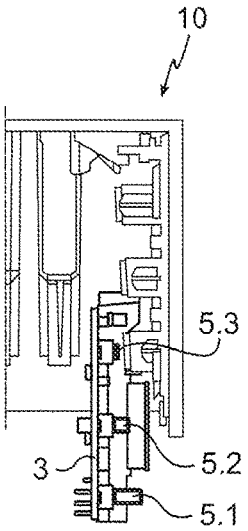
Figure 3C:
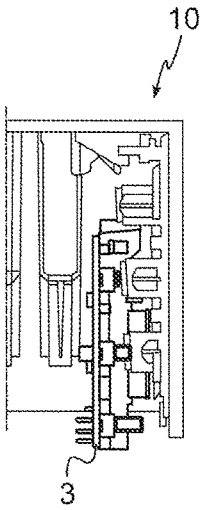
Figure 3D:
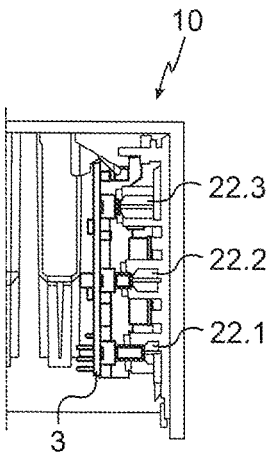
Figure 4:
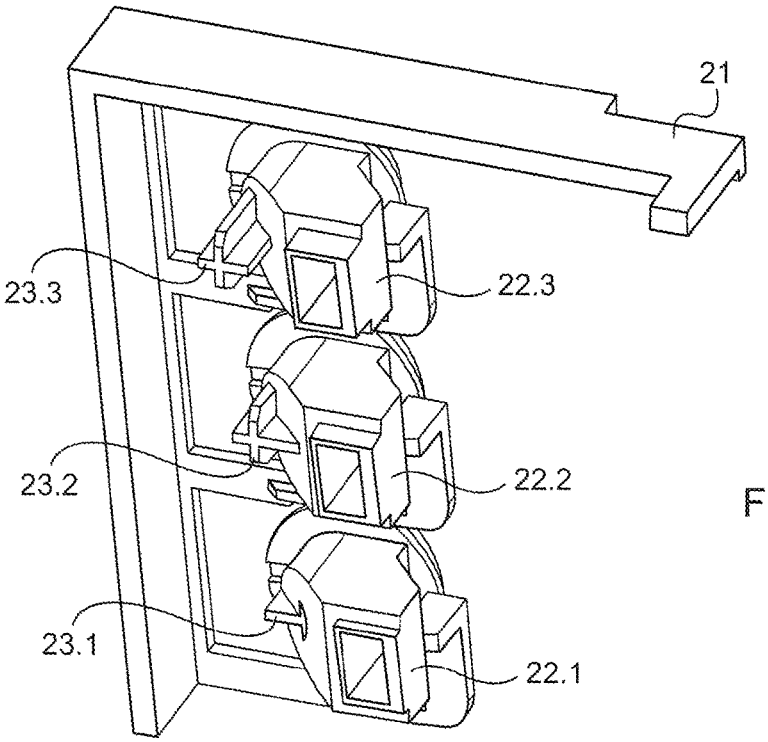
FIG. 4 is a perspective view of a sub-assembly comprising push buttons before they are mounted in the box.

With reference to the figures, in this embodiment, the equipment of the invention is a television decoder, but it could also be an Internet gateway or any other electronic, and optionally multimedia, equipment.

The electronic equipment, given overall reference 1, comprises a plate 2, forming a chassis and having in this embodiment a rectangular shape, which possesses a bottom face provided with studs that are to rest flat on a support and a top face provided with electronic cards, each comprising a printed circuit board (PCB), and one of the cards having the reference 3 extends perpendicularly to the plate 2 and along one side of the plate 2.

In this embodiment, the printed circuit board 3 has a display unit 4 of the liquid crystal display (LCD) type, three switches 5.1, 5.2, 5.3 aligned in a direction that is perpendicular to the plate 2, three light-emitting diodes (LEDs) 6.1, 6.2, 6.3 each placed next to one of the switches 5.1, 5.2, 5.3, and light-tight frames 7.1, 7.2, 7.3 surrounding the LEDs 6.1, 6.2, 6.3. The switch 5.1, the LED 6.1, and the light-tight frame 7.1 are closest to the plate 2. The switch 5.3, the LED 6.3, and the light-tight frame 7.3 are closest to the free edge of the printed circuit board 3. In this embodiment, the light-tight frames 7.1, 7.2, 7.3 are combined in a single part.

The chassis 2 is engaged along an engagement direction D into a box 10 having four side walls 11, 12, 13, 14 and a top wall 15. The engagement direction D is parallel to the printed circuit board 3, and in this embodiment it is normal to the plate 2 and to the top wall 15, which in this embodiment is parallel to the plate 2. The side wall 11 extends parallel to and facing the printed circuit board 3 and it is provided both with a window 16 allowing the display unit 4 to be seen, and also with three holes 17.1, 17.2, 17.3 for slidably receiving respective free ends of buttons 20.1, 20.2, 20.3.

In this embodiment, the buttons 20.1, 20.2, 20.3 are tubular, but of very short length, and each has an open end projecting into the box 10 and a closed free end that is received in a respective hole 17.1, 17.2, 17.3 in order to slide perpendicularly to the side wall 11. The closed free end includes a translucent or transparent portion. The buttons 20.1, 20.2, 20.3 are secured to an intermediate support 21 that is fastened to the inside of the box 10 against the side wall 11. The intermediate support 21 is resiliently clip-fastened into the corresponding corner of the box 10.

A first open end of a tubular light guide 22.1, 22.2, 22.3 is fastened on the open end of each button 20.1, 20.2, 20.3. Each light guide 22.1, 22.2, 22.3 has a second open end engaged in the light-tight frame 7.1, 7.2, 7.3. Each light guide 22.1, 22.2, 22.3 also includes a stud 23.1, 23.2, 23.3 projecting facing and almost in contact with a respective switch 5.1, 5.2, 5.3.

Figure 5:
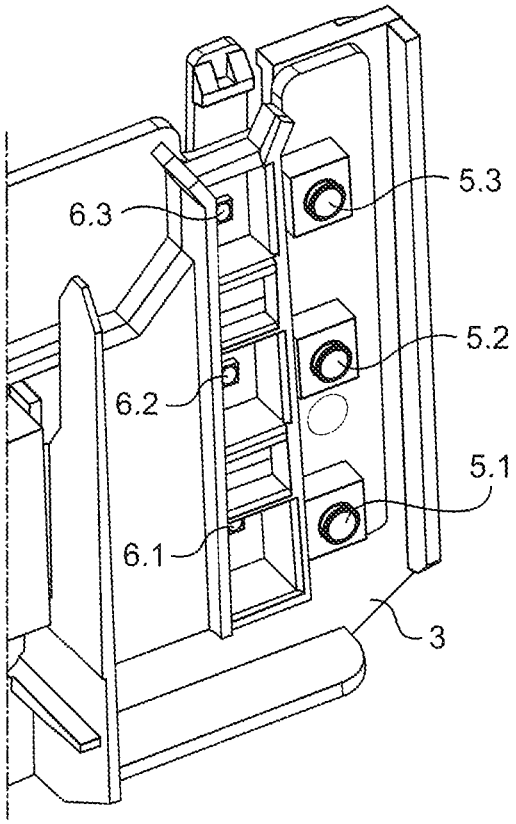
FIGS. 5 and 6 are fragmentary perspective views of the electronic card carrying the switches and the light-tight frame.
Figure 6:
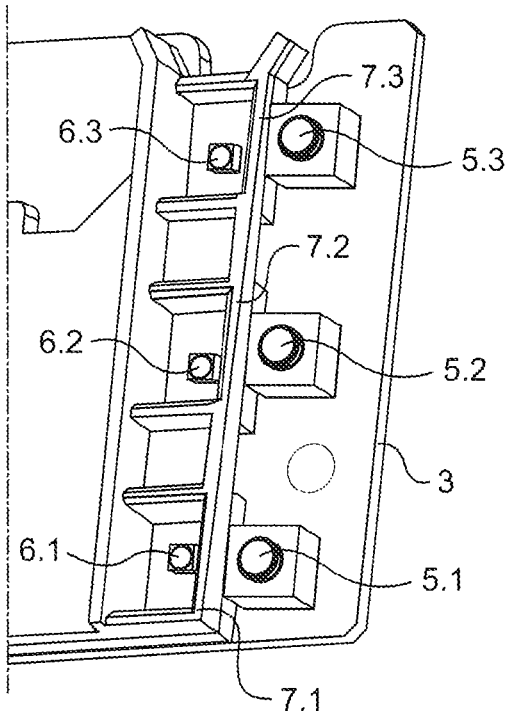

The switches 5.1, 5.2, 5.3 and the light-tight frames 7.1, 7.2, 7.3 are of heights that decrease on going away from the plate 2 (this difference in height of the switches is not visible in FIGS. 1, 5, and 6). Thus, the switch 5.1 is taller than the switch 5.2, which itself is taller than the switch 5.3. The variation in the heights of the switches 5.1, 5.2, 5.3 follows a slope P1. The light-tight frame 7.1 is taller than the light-tight frame 7.2, which itself is taller than the light-tight frame 7.3. The variation in the heights of the light-tight frames 7.1, 7.2, 7.3 follows a slope P2.

The light guides 22.1, 22.2, 22.3 and the studs 23.1, 23.2, 23.3 are of heights that decrease on going towards the plate 2. The variation in the heights of the studs 23.1, 23.2, 23.3 follows the slope P1. The variation in the heights of the light guides 22.1, 22.2, 22.3 follows the slope P2.

The slope P1 is determined so that the switches 5.1, 5.2, 5.3 come into contact with the studs 23.1, 23.2, 23.3 only once the plate 2 is fully engaged in the box 10. The slope P2 is determined so that the light-tight frames 7.1, 7.2, 7.3 come into contact with the light guides 22.1, 22.2, 22.3 only once the plate 2 is fully engaged in the box 10. In this embodiment, the slope P1 is steeper than the slope P2.

The switches 5.1, 5.2, 5.3 and the studs 23.1, 23.2, 23.3 have free faces for bearing against each other that extend parallel to the engagement direction D. The light-tight frames 7.1, 7.2, 7.3 and the light guides 22.1, 22.2, 22.3 have edges bearing against each other that extend parallel to the slope P2.

Assembling the equipment includes a stage of assembling the chassis, a stage of assembling the box, and a stage of assembling the chassis and the box together.

The stage of assembling the chassis comprises the following steps:

mounting on the electronic card 3 the switches 5.1, 5.2, 5.3 and the light sources 6.1, 6.2, 6.3 surrounded by the light-tight frame 7.1, 7.2, 7.3;

mounting the electronic card 3 on the chassis 2 so that it extends parallel to the engagement direction D.

The stage of assembling the box comprises the step of mounting the push buttons 20.1, 20.2, 20.3 and the light guides 23.1, 23.2, 23.3 on the face 11 of the box in such a manner that the push buttons slide perpendicularly to said face and the light guides project into the box.

The stages in which the box and the chassis are themselves assembled may be performed simultaneously or in succession.

The stage of assembling the chassis and the box together consists in engaging the chassis 2 in the box 10 in an engagement direction D until engagement is complete and the light-tight frames and the ends of the light guides come mutually into contact.

Permanent fastening of the chassis 2 to the box 10 is obtained by screw-fastening, clip-fastening, riveting, heading, or any other means.

Naturally, the invention is not limited to the embodiments described but encompasses any variant coming within the ambit of the invention as defined by the claims.

In particular, the heights may vary with slopes that are identical.

In the event that only switches of the same height can be found on the market, it is possible to produce a light-tight frame that is provided with tabs hinged to an edge of the light-tight frame in order to extend sideways from the light-tight frame, each above one of the switches, the tabs having different thicknesses that vary with the slope P1.

The invention claimed is:

1. An electronic equipment comprising a chassis engaged in a box having a face parallel to an engagement direction for engaging the chassis in the box and provided with at least one push button that is mounted to slide perpendicularly to said face and that includes a light guide projecting into said box, at least one electronic card being mounted on the chassis so as to extend parallel to said face of the box and being provided with at least one switch designed to cooperate both with the push button and also with at least one light source that is surrounded by a light-tight frame, which frame receives a free end of the light guide, the light-tight frame being of height that decreases on going away from the chassis and the end of the light guide being of height that decreases in an opposite direction so that they come mutually into contact only once the chassis is fully engaged in the box.

2. The equipment according to claim 1, wherein said face of the box is provided with a plurality of buttons aligned parallel to the engagement direction and the electronic card is fitted with a same number of switches aligned in a same direction, the buttons and the switches being provided with mutual bearing surfaces of heights that vary with corresponding slopes so that they come mutually into contact only once the chassis is fully engaged in the box.

3. The equipment according to claim 2, wherein the switches are of heights that decrease on going away from the chassis, a slope of the decreasing heights for the switches is steeper than the slope of decrease for the light-tight frame.

4. The equipment according to claim 1, wherein the light-tight frame is provided with tabs hinged to an edge of the light-tight frame in order to project sideways from the light-tight frame, each above one of the switches, the tabs having different thicknesses that vary with a slope, and having top surfaces that form mutual bearing surfaces.

5. The equipment according to claim 1, wherein each button is secured to an intermediate support fastened to the box.

6. A method of mounting equipment according to claim 1, the method comprising steps of:

mounting on the electronic card the switch for co-operating with the push button and the light source surrounded by the light-tight frame;

mounting the electronic card on the chassis so that the electronic card extends parallel to an engagement direction;

mounting the push button and the light guide on the face of the box that is parallel to the engagement direction in such a manner that the push button slides perpendicularly to said face and the light guide projects into the box; and engaging the chassis in the box along the engagement direction until the light-tight frame and the end of the light guide come mutually into contact.

* * * * *